US008202104B2

(12) United States Patent
Wang

(10) Patent No.: US 8,202,104 B2
(45) Date of Patent: Jun. 19, 2012

(54) ELECTRICAL SOCKET

(75) Inventor: Pao-Chang Wang, Linkou (TW)

(73) Assignee: Pao-Chang Wang, Taipei (TW)

( * ) Notice: Subject to any disclaimer, the term of this patent is extended or adjusted under 35 U.S.C. 154(b) by 0 days.

(21) Appl. No.: 13/018,423

(22) Filed: Feb. 1, 2011

(65) Prior Publication Data

US 2012/0100734 A1 Apr. 26, 2012

(51) Int. Cl.
*H01R 29/00* (2006.01)

(52) U.S. Cl. ..... 439/188; 200/51.09

(58) Field of Classification Search ..... 439/188; 200/51.09, 51.11, 51.12
See application file for complete search history.

(56) References Cited

U.S. PATENT DOCUMENTS 5,865,635 A * 2/1999 Hsiang et al. ..... 439/188
7,445,472 B1 * 11/2008 Huang et al. ..... 439/138
7,641,489 B1 * 1/2010 Hsu et al. ..... 439/188
7,887,349 B1 * 2/2011 Macomber ..... 439/188
7,967,620 B1 * 6/2011 Baldwin et al. ..... 439/188
2011/0059637 A1 * 3/2011 Macumber ..... 439/188
* cited by examiner

*Primary Examiner* — Gary F. Paumen

(57) ABSTRACT

The present invention relates to an electric socket having at least two insertion holes of upper lid, a base with two axles, two insertion objects, a touch tone loop and a movable element. The insertion object has two elastic plates and two contact plates, the contact plates respectively have a contact portion; the touch tone loop comprises two movable plates and two fixture plates. The movable plates respectively have a contact portion; the fixture plates respectively have a contact portion corresponding to the contact portion of the contact plates, and a contact portion corresponding to the contact portion of the movable plates. The movable element has two bars, two blocks and two elastic elements. The bar has an end connected to the movable plate and the other end thereof connected to the block. By using an assembly of a insertion object, a touch tone loop and a moveable element to control contact or non-contact of the contacting portion of the touch tone loop with the contact portion of the insertion object for connection or non-connection of the loop formed by the insertion object, the fixture plate and the movable plate, and thereby achieve prevention of electric shock by accidentally plugging wrong object.

10 Claims, 23 Drawing Sheets

ELECTRICAL SOCKET

BACKGROUND OF THE INVENTION

1. Field of the Invention

The present invention relates to a electrical socket, and more particularly to a safety device with an improved circuit loop for a socket for preventing electric shock occurring due to accidental plugging.

2. Description of Related Art

As electrical household appliances are widely used in daily life, such as a television set, a computer, a washer and so on, and a socket, a plug and other power transmission devices have become personal daily necessity as well. However, generally speaking, the insertion hole of the household socket is usually without lid, even with a safety cap or an extra switch. If the safety cap has been opened or switch is being turned on by an accident and the socket has been inserted with hazardous object, the electric shock can easily occur. In order to prevent the above defect, there are many types of electrical socket for preventing electric shock are available on the market.

Referring to FIG. 1, an exploded view of a conventional electrical socket, the socket 1 has a set of positioning unit at a bottom thereof comprises two high positioning elements 11 and two low positioning elements 12. The high positioning elements 11 are positioned at the two sides of the low positioning elements 12 respectively. A U shape opening 111 is formed atop of the high positioning element 11 for receiving two sliding boards 2. The two low positioning elements 12 are positioned side by side corresponding to the sliding boards 2, and have a semicircular groove 121 on a top thereof for positioning the beam 3 to provide the sliding board 2 for left and right movement. Two sets of long and short plates 4, 5 respectively securely and movably positioned within the socket on the two sides to correspond to the position of the slot 13. Thus, one side of the slot 13 having insertion object will not conduct electricity; however, the other side of the slot 13 can still conduct electricity.

The conventional design has defect, for instance, one side of the slot 13 having insertion object will not conduct electricity but the other side of the slot 13 can still conduct electricity; if two sides of the slot 13 both have insertion objects, for example, metallic clamp, the sliding boards can be pushed away easily to cause the electric shock.

Therefore, the present invention provides a electrical socket having an assembly of an insertion object, a touch tone loop and a moveable element for controlling upon attachment or detachment of the contacting portion of the touch tone loop with the contact portion of the insertion object for connection of disconnecting the loop formed by the insertion object, the secured plate and the movable plate, to achieve feature of preventing electric shock by plugging a wrong object.

SUMMARY OF THE INVENTION

An objective of the present invention is to provide a electrical socket for preventing electric shock by plugging wrong object.

According to an aspect of the present invention, the embodiment of the present invention provides a electrical socket having a loop conducting, wherein only an insertion object is a standard plug.

For achieving the above objectives, an electrical socket of the present invention comprises at least two insertion holes of the upper lid, a base with two axles, two insertion objects, a touch tone loop and a movable element. The insertion object comprises two elastic plates and two contact plates. The contact plates respectively have a contact portion; and the touch tone loop comprises two movable plates and two fixture plates. The movable plates respectively comprise a contact portion; the fixture plates respectively comprise a contact portion corresponding to the contact portion of the contact plates, and a contact portion corresponding to the contact portion of the movable plates. The movable element comprises two bars, two blocks and two elastic elements. The bar has an end connected to the movable plate and the other end thereof connected to the block. The insertion object, the touch tone loop and the movable element are positioned within the upper lid and the base, and the movable element is positioned below the insertion object.

The inserted element of the above electrical socket further comprises an elastic element connected to the contact plate.

The inserted element and touch switch loop of the above electrical socket are securely positioning on the base.

The bars and the blocks of the movable element of the electrical socket are made of an insulating material.

The electrical socket further comprises two elastic plates and two fixture plates.

The contact portions of the electrical socket are separate from each other and the loop can be conducted by plugging a standard size of the plug.

The fixture plate, the movable plate, the bars and blocks of the electrical socket can be formed in various shapes depending on the requirement.

The contact portion of the insertion object and the contact portion of the touch switch loop of the electrical socket can be on various positions depending on the requirement.

Accordingly, the present invention has an assembly comprising the insertion object, the touch tone loop and the movable element having contact or no contact between the contact portion of the touch tone loop and the inserted element to have the loop connected or disconnected in the inserted element, the fixture plate and the movable plate and thus to prevent electric shock from occurring due to accidental plugging. Therefore, the safety of the usage of the socket can be substantially upgraded.

BRIEF DESCRIPTION OF THE DRAWING

For more complete understanding of the present invention, reference will now be made to the following detailed description of preferred embodiments taken in conjunction with the following accompanying drawings.

DETAIL DESCRIPTION OF THE INVENTION

Figure 1:
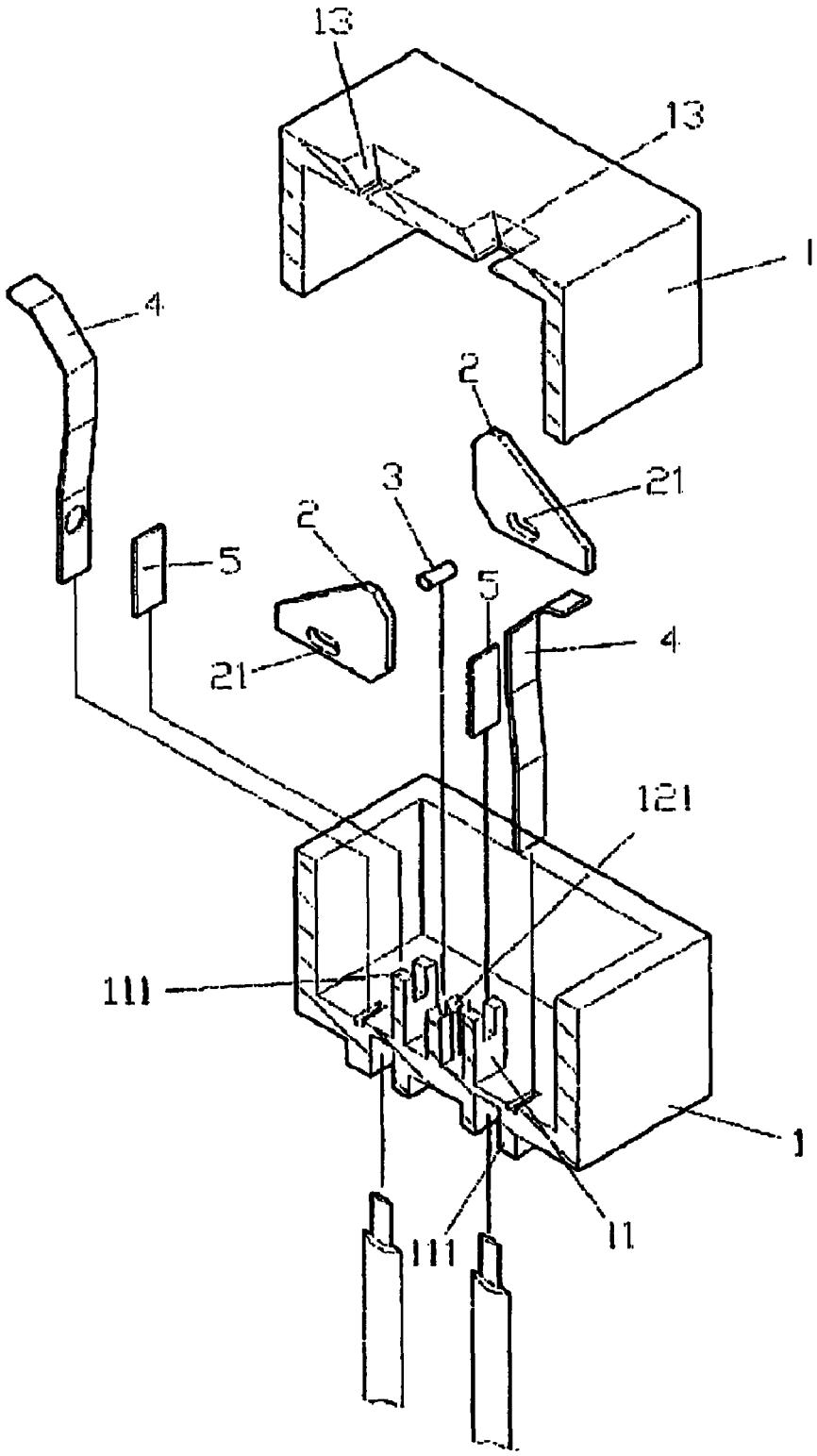
FIG. 1 is an exploded view of a conventional electrical socket.
Figure 2:
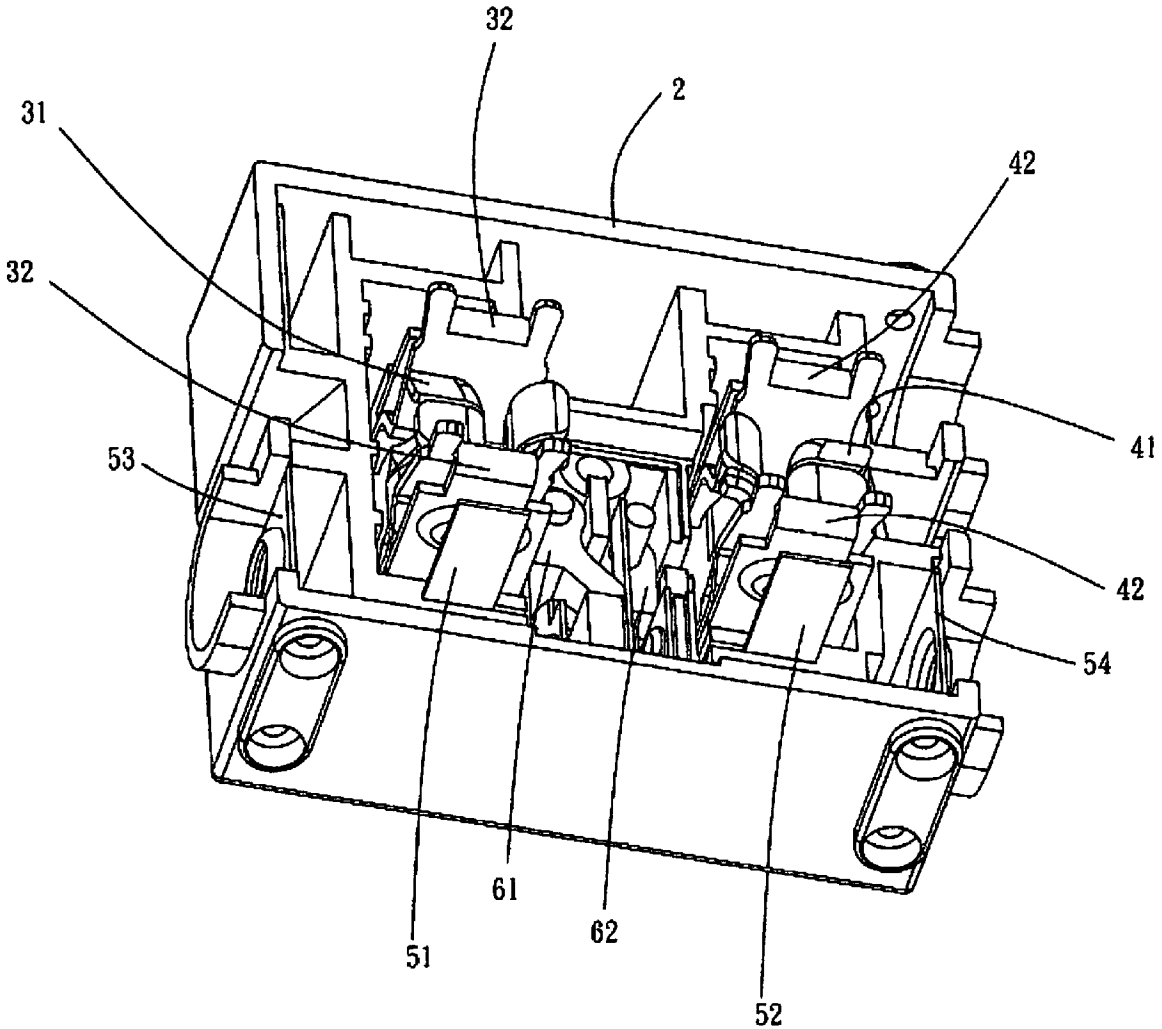
FIG. 2 is an elevational view according to a first embodiment of the present invention.
Figure 3:
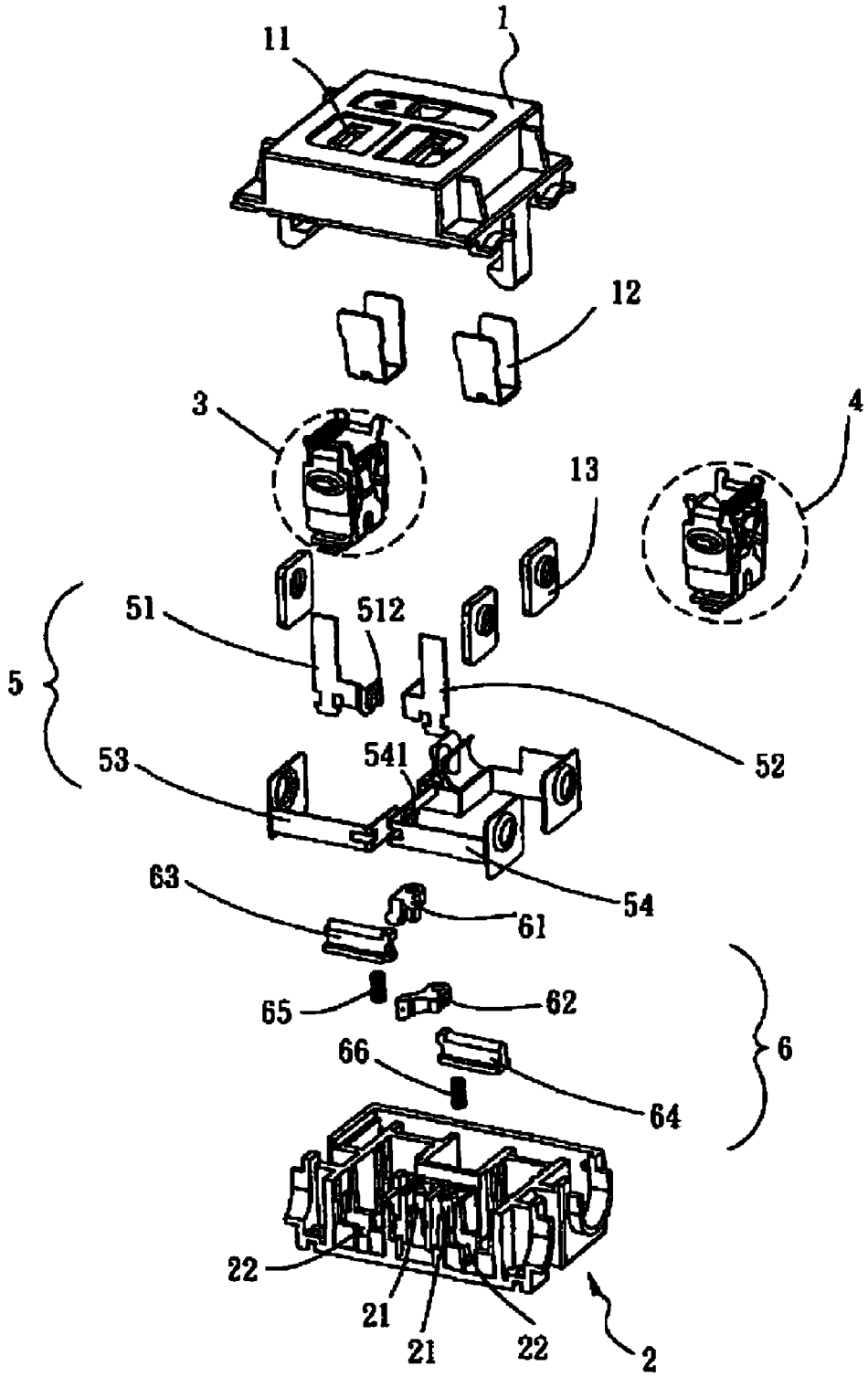
FIG. 3 is an exploded view according to the first embodiment of the present invention.
Figure 4:
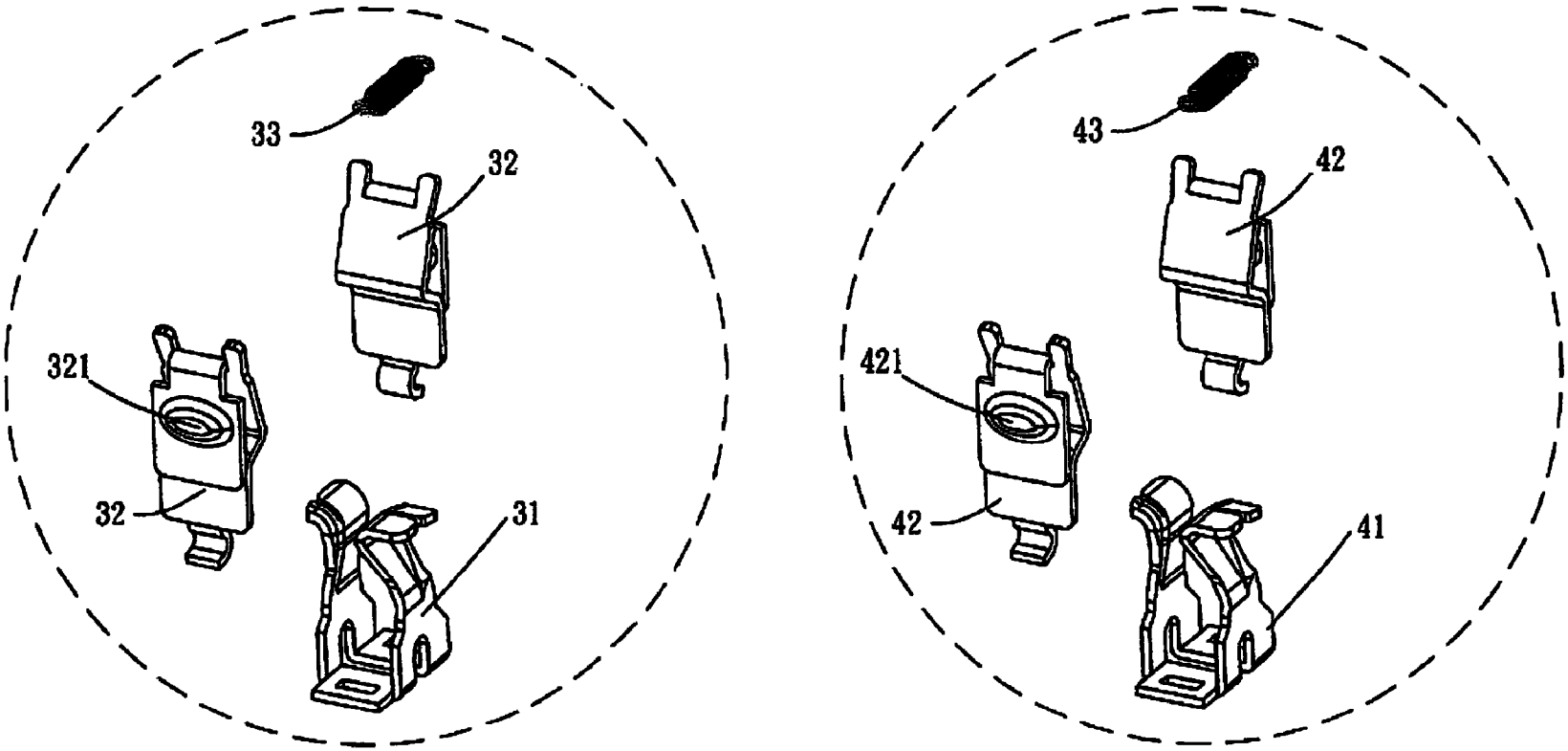
FIG. 4 is an enlarged view of an insertion object according to the first embodiment of the present invention.
Figure 5:
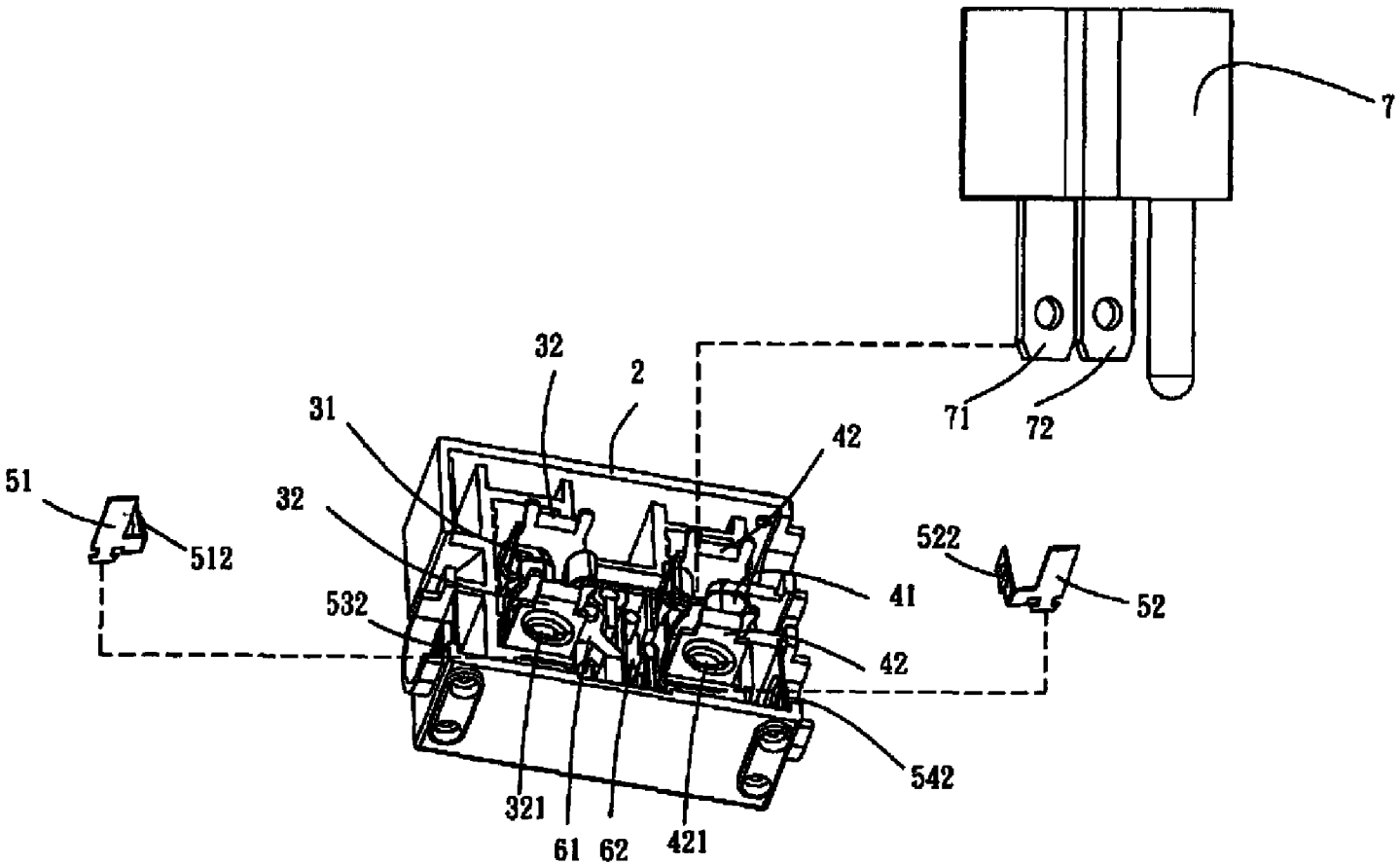
FIG. 5 is an aspect view of the assembly according to the first embodiment of the present invention.

Referring to FIGS. 2 to 5, the electrical socket of the first embodiment comprises a upper lid 1 having at least two insertion holes 11, a base 2 with two axles 21, two insertion elements 3, 4, a touch switch loop 5 and a movable element 6. The insertion elements 3, 4 comprise two elastic plates 31, 41 and two contact plate 32, 42. The contact plates 32 and 42 respectively comprise contact portions 321 and 421. The touch switch loop 5 comprises two fixture plates 51 and 52 and two movable plates 53 and 54. The fixture plates 51 and 52 have contact portions 511 and 521 positioned corresponding to the contact portions 321 and 421 of the contact plates 32 and 42, and have contact portions 512 and 522 positioned corresponding to the contact portions 531 and 541 of the movable plates 53 and 54. The movable plates 53 and 54 have contact portions 531 and 541. The movable element 6 comprises two bars 61 and 62, two blocks 63 and 64 and two elastic elements 65 and 66. The bars 61 and 62 have an end connected to the movable plates 53 and 54, and the other end buckled to the blocks 63 and 64.

The insertion elements 3 and 4, the touch switch loop 5 and the movable element 6 are positioned within the upper lid 1 and the base 2. The insertion elements 3 and 4, the touch tone loop 5 are securely positioned on the base 2 in the embodiment, and the movable element 6 is positioned below the insertion elements 3 and 4. In this embodiment, the insertion elements 3 and 4 respectively have an elastic element 33 and 43. The elastic elements 33 and 34 respectively connect to the contact plates 32 and 42 to protect the contact plates 32 and 42 to prevent the breakage of the contact plates 32 and 42 caused by the insertion of an inappropriate object. The elastic elements 33 and 43 can be a spring or an elastic plate. The bars 61 and 62 and blocks 63 and 64 of the movable element 6 are made of an insulating material. The electrical socket of the embodiment comprises two elastic plates 12, and two fixture plates 13. The contact portions 321, 421, 511, 512, 521, 522, 531 and 541 are positioned separately. In other words, the loop is maintained as an off status, and a standard plug 7 having the pins 71 in the standard length and width can be applied to keep the loop in that conducting status. The fixture plates 51 and 52, the movable plates 53 and 54, bars 61 and 62 and blocks 63 and 64 can be formed in various shapes depending on the requirement. The contact portions 321 and 421 of the insertion elements 3, 4 and the contact portions 511, 512, 521, 522, 531 and 541 of the touch switch loop 5 can be designed on various positions depending on the requirement.

Figures 6A, 6B, 6C:
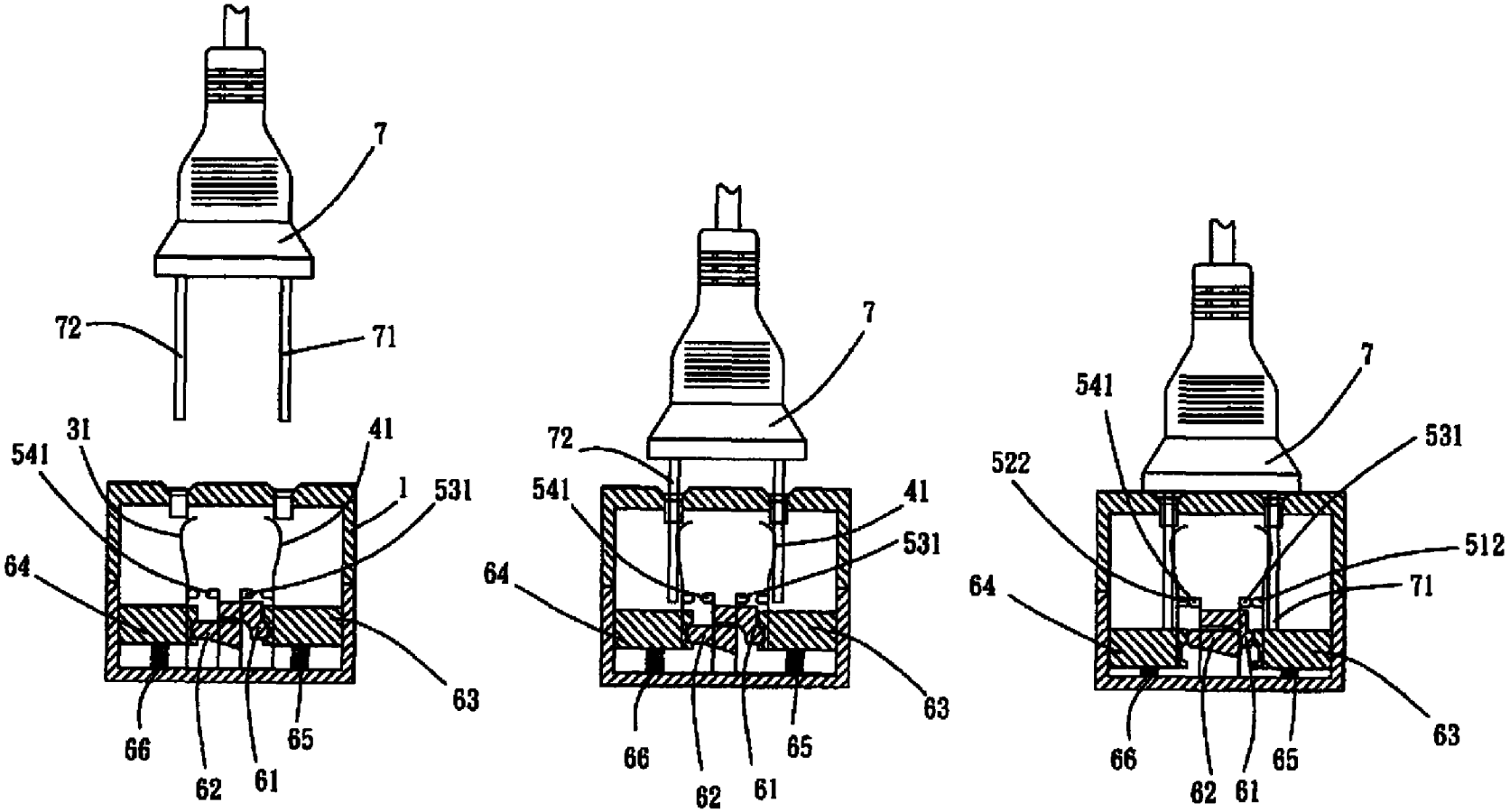
FIG. 6A is a sectional side view illustrating before insertion of the plug according to the first embodiment of the present invention.
FIG. 6B is a sectional side view illustrating while inserting the plug according to the first embodiment of the present invention.
FIG. 6C is a sectional side view illustrating after the insertion of the plug according to the first embodiment of the present invention.
Figure 7:
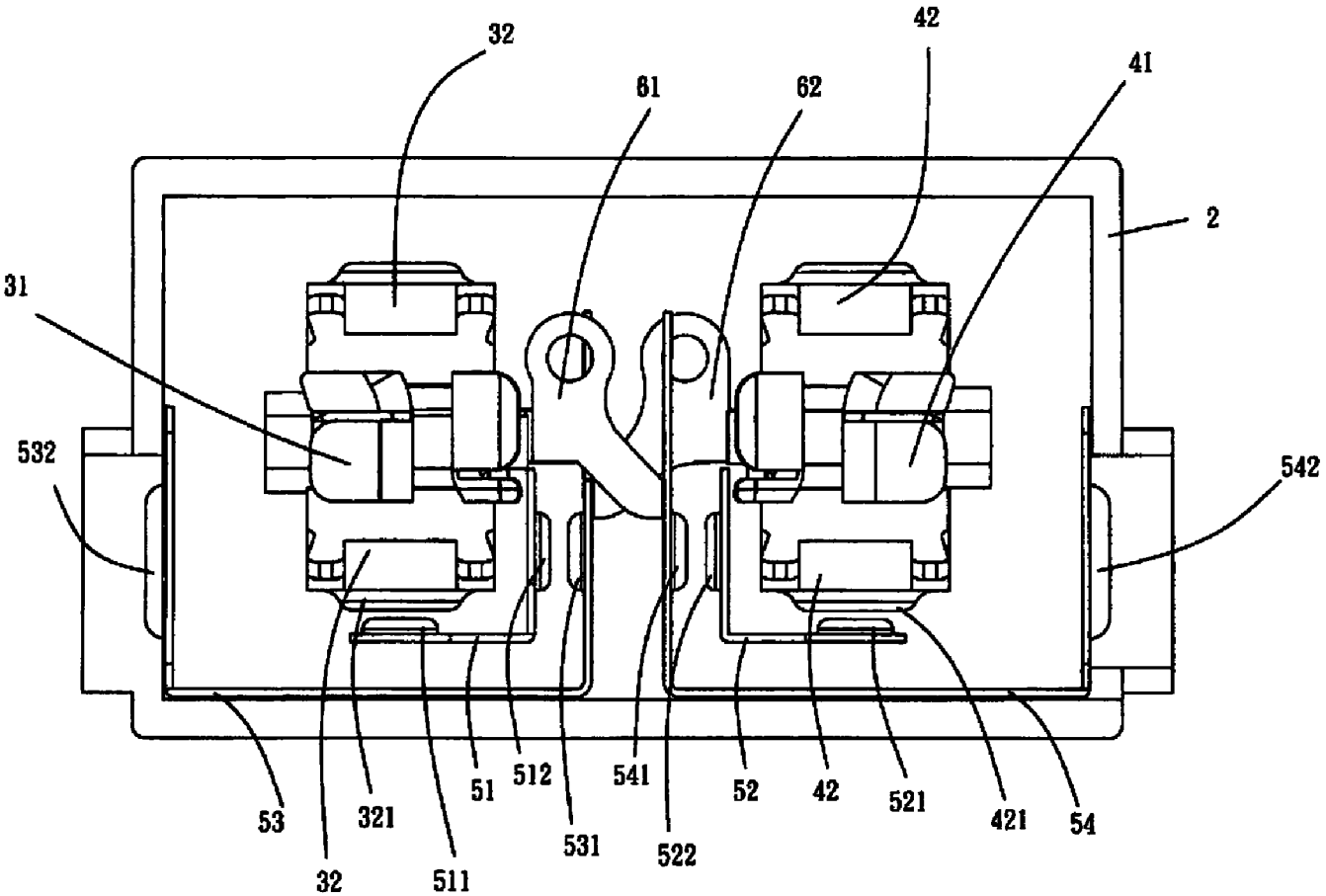
FIG. 7 is a top view illustrating before the insertion of the plug according to the first embodiment of the present invention.
Figure 8:
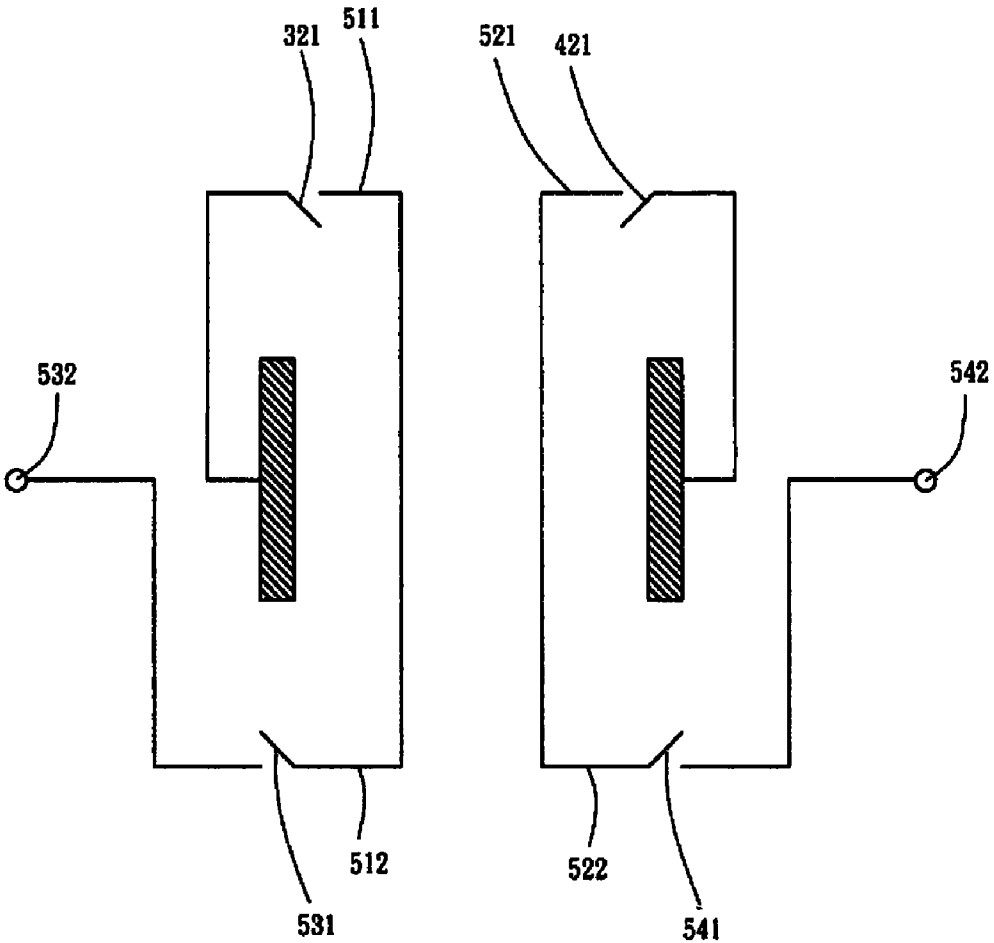
FIG. 8 is an aspect illustrating the loop according to the first embodiment of the present invention.

Referring to FIGS. 6A, 7, and 8, when the pins 71 and 72 of the plug 7 are not yet plugged into the insertion holes 11 of the upper lid 1, the pins 71 and 72 cannot reach to the contact plates 32, 42 of the insertion elements 3 and 4 and the blocks 63 and 64 of the movable element 6. Therefore, the electric loop of the socket is off (as shown in FIG. 8).

Figure 9:
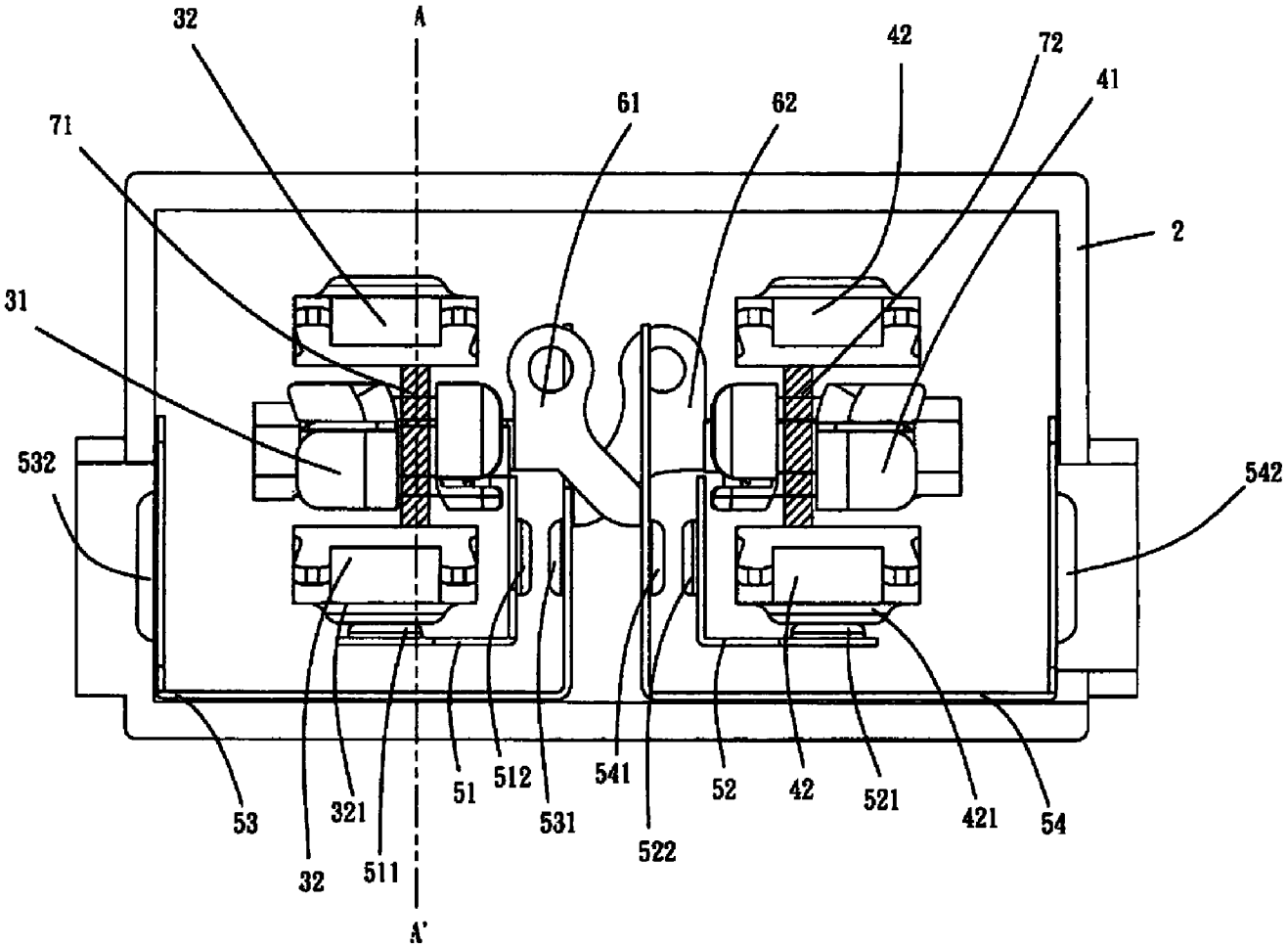
FIG. 9 is a top view illustrating while inserting the plug according to the first embodiment of the present invention.
Figure 10:
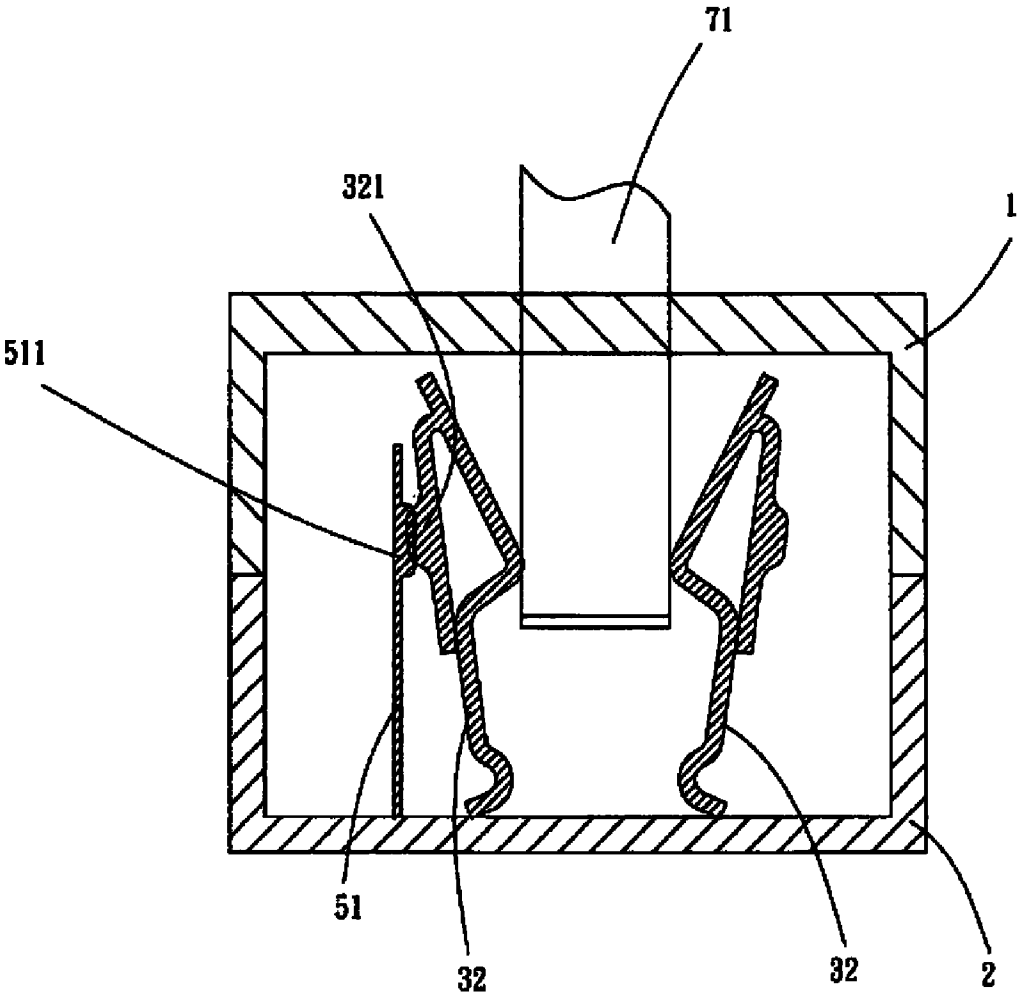
FIG. 10 is a sectional view taken along the A-A' direction of FIG. 9 according to the first embodiment of the present invention.

Referring to FIGS. 6B, 9 and 10, when plugging the plug 7 downwardly, the pins 71 and 72 of the plug 7 contact the elastic plates 31 and 41 and the contact plates 32 and 42 of the insertion elements 3 and 4 to accordingly bend the contact plates 32, 42 outwardly (as shown in FIG. 10). The contact portions 321 and 421 of the contact plates 32 and 42 contact the contacting portions 511, 521 of the fixture plates 51 and 52. However, the pins 71 and 72 do not yet contact the blocks 63 and 64 of the movable element 6 to allow the contact portion 512 and 522 of the fixture plates 51 and 52 to have contact with the contact portions 531 and 541 of the movable plates 53 and 54. Meanwhile, the elastic plates 31 and 41 not connect the movable plates 53 and 54, and accordingly the loop is off. The movable plates 53 and 54 have the other end as a grounding contact 532 and a live wire contact 542, thus the input power of the live wire cannot be transmitted to the elastic plate 41.

Figure 11:
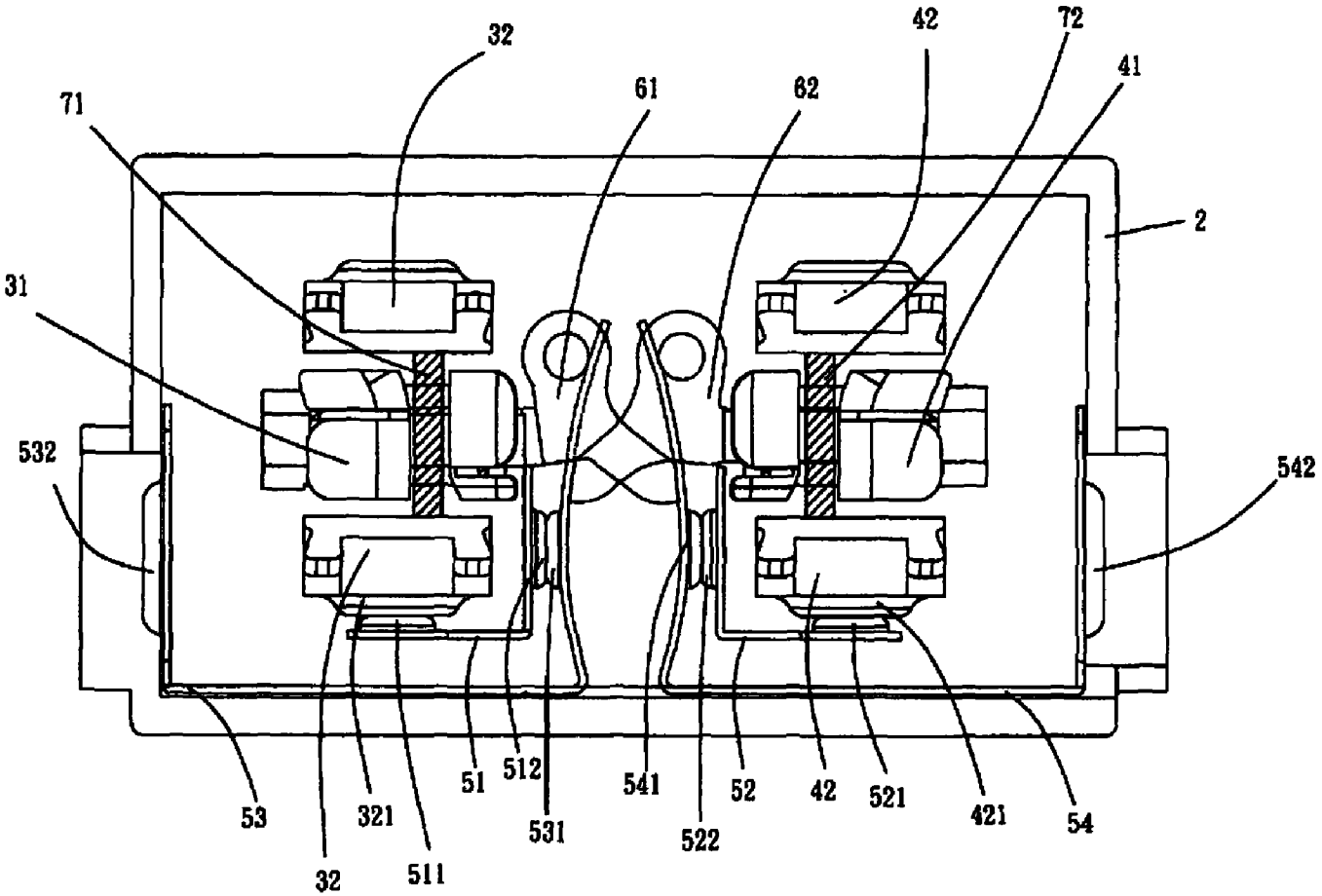
FIG. 11 is a top view illustrating after insertion of the plug according to the first embodiment of the present invention.
Figure 13A:
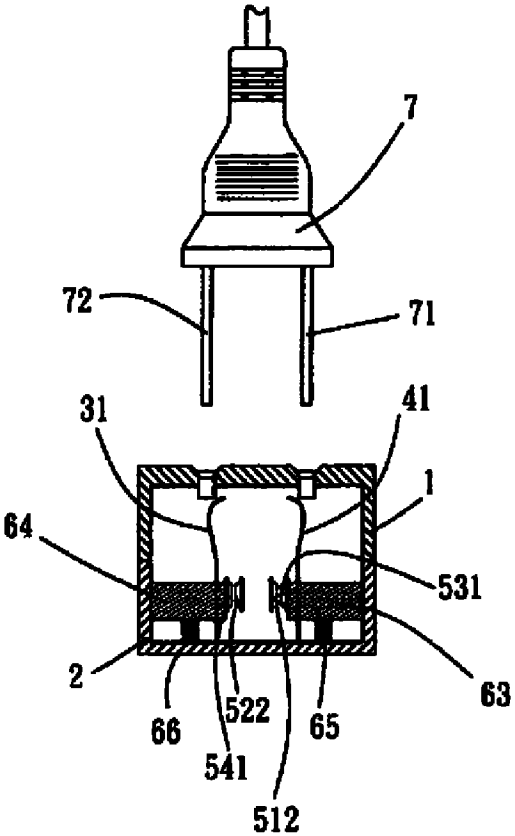
FIG. 13A is a sectional side view illustrating before insertion of the plug according to the second embodiment of the present invention.
Figure 13B:
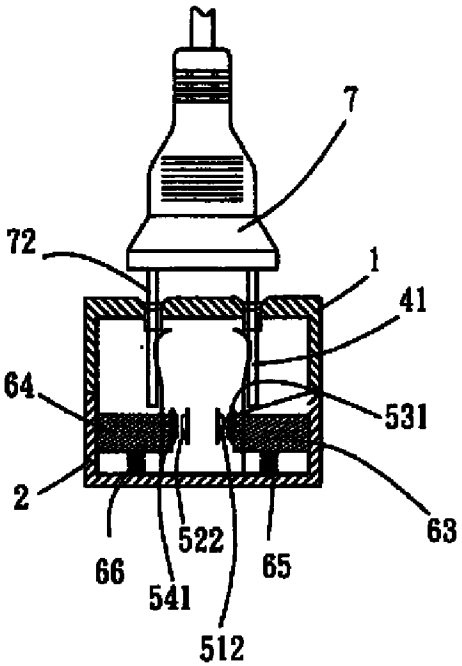
FIG. 13B is a sectional side view illustrating while inserting the plug according to the second embodiment of the present invention.
Figure 13C:
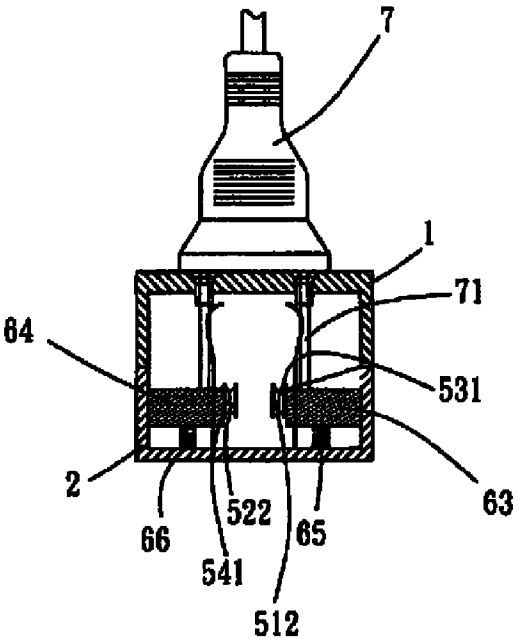
FIG. 13C is a sectional side view illustrating after insertion of the plug according to the second embodiment of the present invention.
Figure 12:
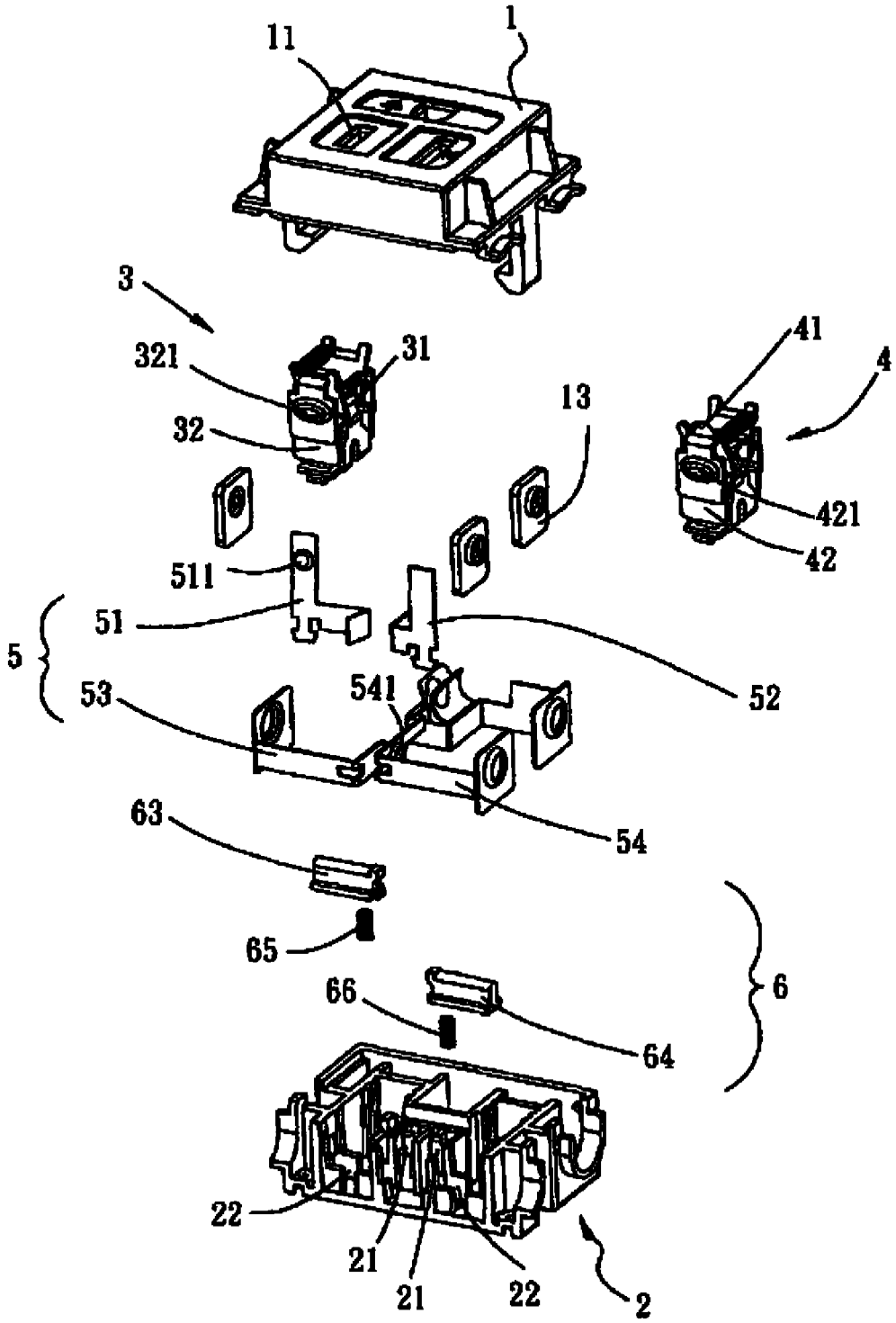
FIG. 12 is an exploded view according to a second embodiment of the present invention.

Referring to FIGS. 6C and 11, when the plug 7 is completely plugged in and the pins 71 and 72 contact the blocks 63 and 64, contact portions 321 and 421 of the contact plates 32 and 42 contact the contact portions 511 and 521 of the fixture plates 51, 52. The blocks 63 and 64 bear the downward force from the pins 71 and 72 and the rebound of the elastic elements 65 and 66 positioned below the blocks 63 and 64, the blocks 63 and 64 move up and down within the groove 22 of the base 2. During the movement of the blocks 63 and 64, the axle 21 of the base 2 rotate along with the bars 61 and 62, and furthermore, the contact portions 531 and 541 of the movable plates 53 and 54 are motivated to approach towards the contact portions 512 and 522 of the fixture plates 51, 52 respectively and to further have contact due to the connection to the bars 61 and 62. Meanwhile, the loop of the socket is on, in other words, the input power of the live wire can transmit power to the elastic plate 41 to enable the plug 7 receive the input power.

To turn on the whole loop while using the socket of the present invention, the four touch tone loops are activated in a status of long closed contact; the touch switch loop is formed by the corresponding bars 61 and 62. If only one side of the insertion holes 11 has the insertion object, for example the metallic wire having too small the figure to bend the contact plate 42 outwardly, thus the loop cannot be turned on. Even the insertion object has the same size and shape as the pins of the standard plug, only the contact portion 421 of the contact plate 42 is contacted to further have contact with the contact portion 521 of the fixture plate 52, and the contact portion 531 of the movable plate 53 positioned on the other side to contact the contact portion 512 of the fixture plate 51, the loop on either side still cannot be turned on, and that's how electric shock can be prevented. If the insertion holes 11 have been inserted by objects respectively, the loop will not be turned on easily because of the inserting objects of size and shape being different from the standard plug.

Referring to FIGS. 12, 13A, 13B and 13C, the structure of the present invention can be different from that of the first embodiment, such as shown in embodiment 2. Without two elastic plates 12 and the bars 61 and 62 of the movable element 6 in this embodiment, the movable element 6 comprises two blocks 63 and 64 and two elastic elements 65 and 66, and the elastic elements 65 and 66 are positioned below the blocks 63 and 64.

Figure 14:
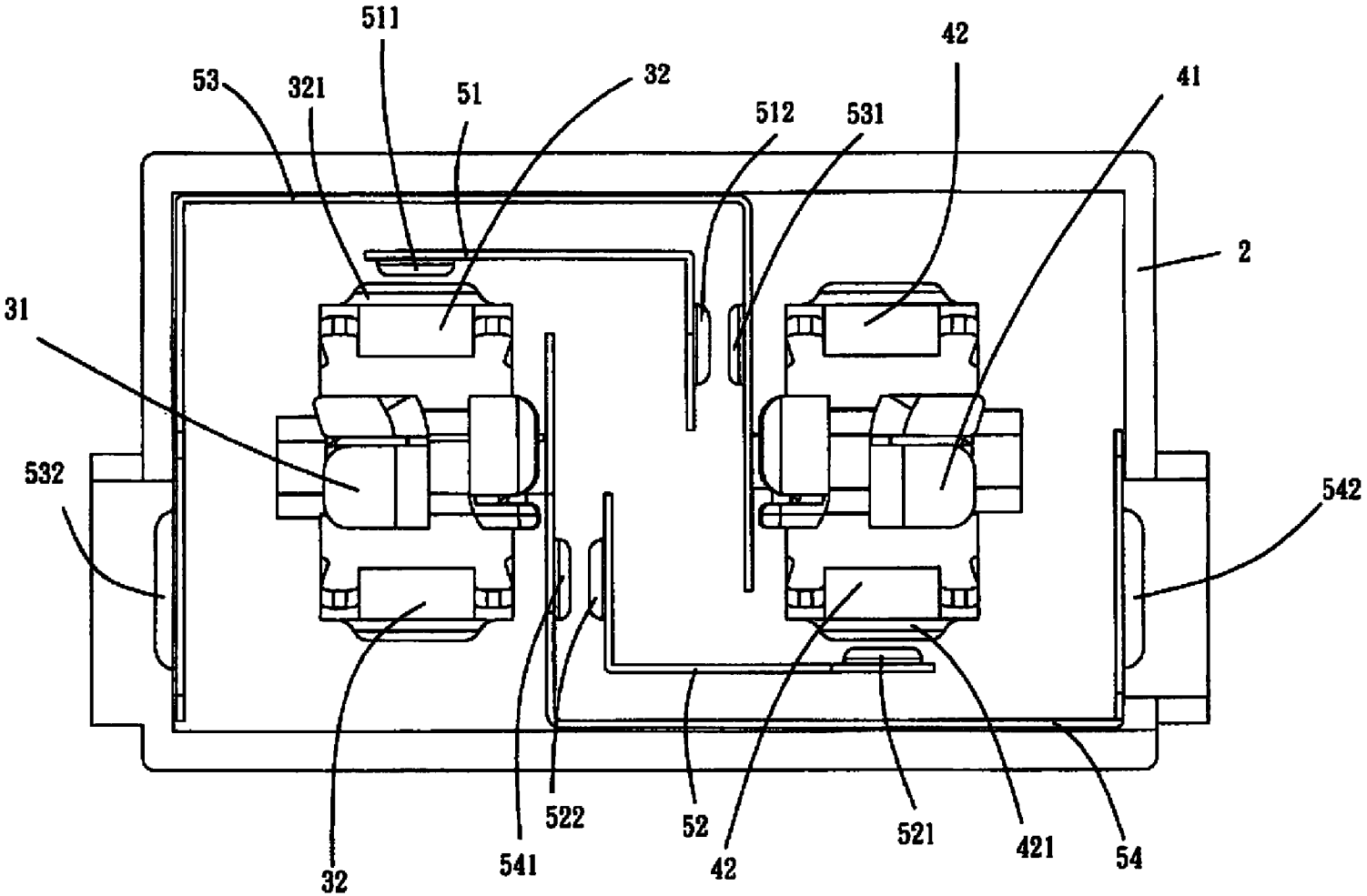
FIG. 14 is a top view illustrating before insertion of the plug according to the second embodiment of the present invention.
Figure 15:
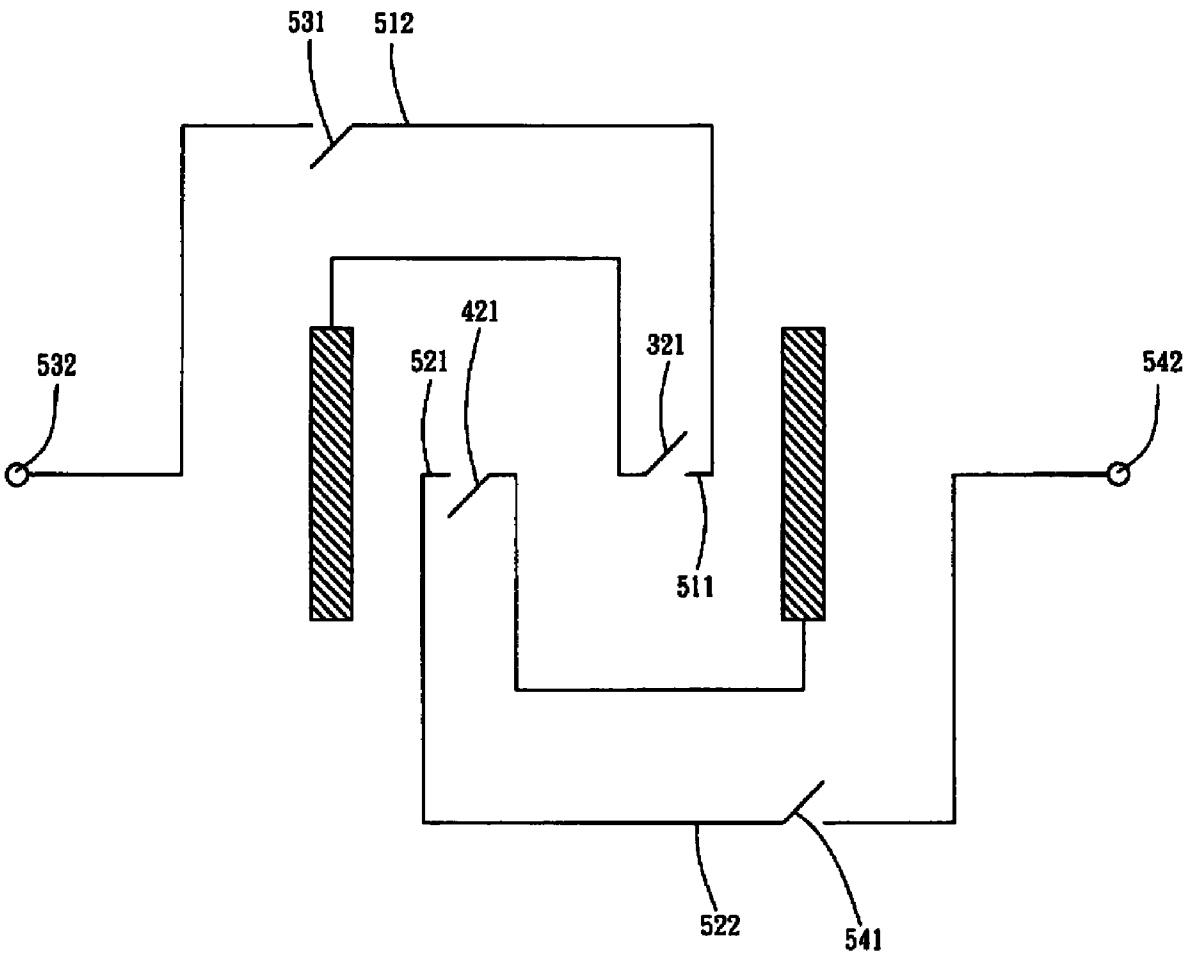
FIG. 15 is an aspect illustrating the loop according to the second embodiment of the present invention.
Figure 16:
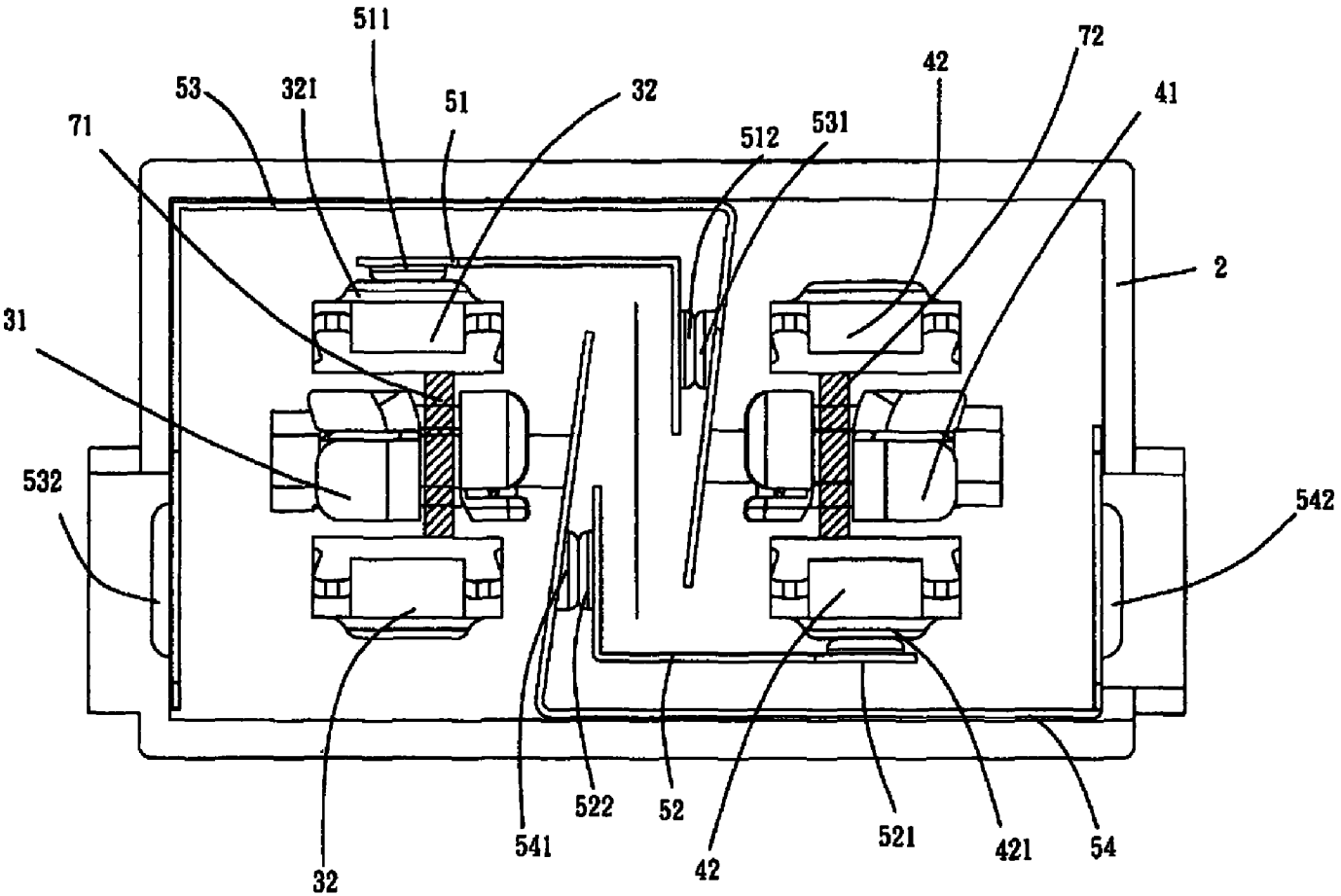
FIG. 16 is a top view illustrating while inserting the plug according to the second embodiment of the present invention.
Figure 17:
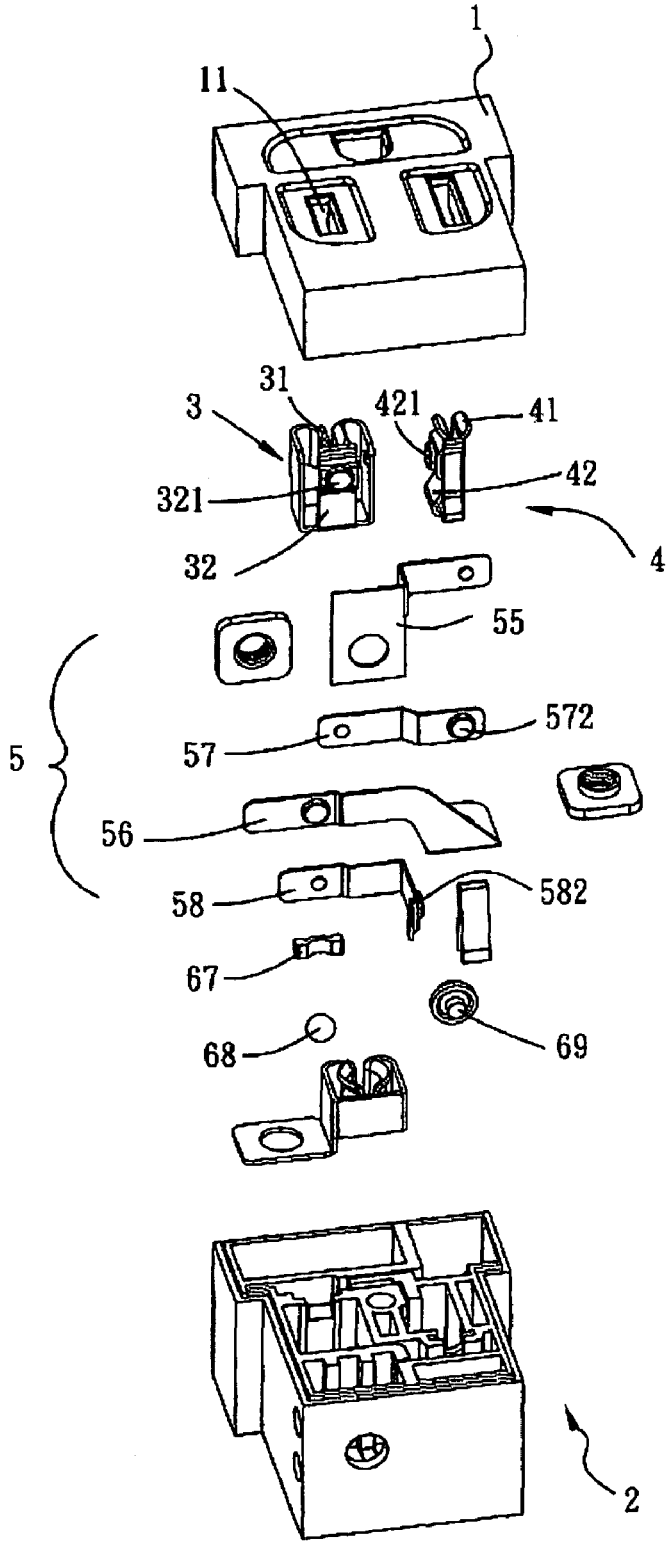
FIG. 17 is an exploded view according to a third embodiment of the present invention.

When the plug 7 is plugged in downwardly, the pins 71 and 72 of the plug 7 will contact with the elastic plate 31, 41 and the contact plates 32 and 42 of the insertion objects 3 and 4 bend the contact plate 32, 42 outwardly, the contact portions 321 and 421 of the contact plates 32 and 42 contact the contact portions 511 and 521 of the contact plate 51 and 52 (referring to FIG. 14). However, the pins 71, 72 do not come in contact the blocks 63 and 64 of the movable element 6 to enable the fixture plates 51 and 52 contacting the movable plates 53 and 54. When the plug 7 is completely inserted to allow the pins 71 and 72 to contact the blocks 63 and 64, the blocks 63 and 64 receive the downward force from the pins 71 and 72 and the rebound from the elastic elements 65 and 66 positioned underneath, thus allow to move up and down within the groove 22 of the base 2. Furthermore, the blocks 63 and 64 push the contact plates 531 and 541 of the movable plates 53 and 54 towards the contact portions 512 and 522 of the fixture plates 51, 52 respectively to contact and to form a loop. Accordingly, the effect of the first embodiment can be achieved even with fewer components.

According to a third embodiment of the present invention, referring to FIGS. 17 to 20, the electrical socket comprises an upper lid 1 with at least two insertion holes 11, a base 2, two insertion objects 3 and 4, a touch switch loop 5 and a movable element 6. The insertion objects 3 and 4 respectively have two elastic plates 31 and 41 and two contact plates 32 and 42. The contact plates 32 and 42 respectively have contact portions 321 and 421. The touch switch loop 5 comprises two fixture plates 55 and 56 and two movable plates 57 and 58. The fixture plates 55 and 56 respectively have contact portions 551 and 561 positioned corresponding to the contact portions 572 and 581 of the movable plates 57 and 58. The movable plates 57 and 58 respectively have contact portions 571 and 582 positioned corresponding to the contact portions 321 and 421 of the contact plates 32 and 42. The movable element 6 comprises a block 67, a ball 68 and an axial protrusion 69. The block 67 has an end positioned against the back of the contact portion 581 of the movable plate 58. The ball 68 is positioned between the block 67 and the elastic plate 31. The tray protrusion 69 is positioned between the contact portion 572 and the elastic plate 41.

Figure 18A:
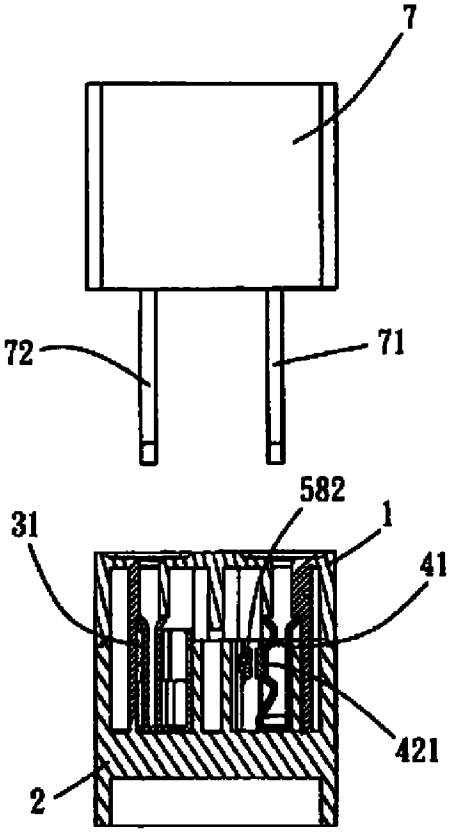
FIG. 18A is a sectional side view illustrating before the insertion of the plug according to the third embodiment of the present invention.
Figure 18B:
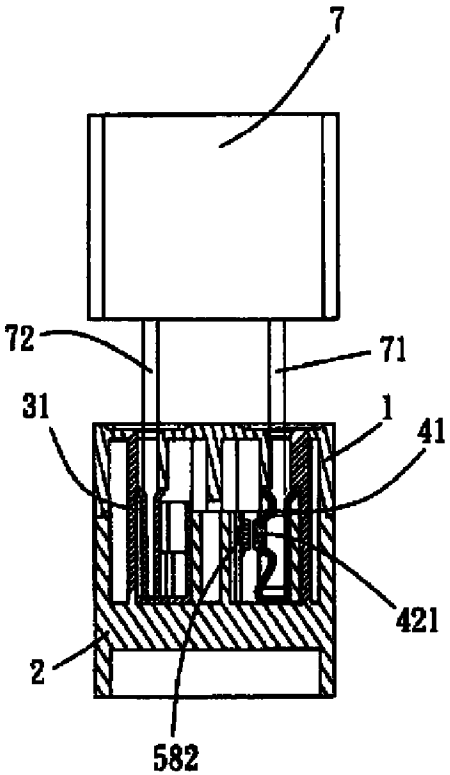
FIG. 18B is a sectional side view illustrating while inserting the plug according to the third embodiment of the present invention.
Figure 18C:
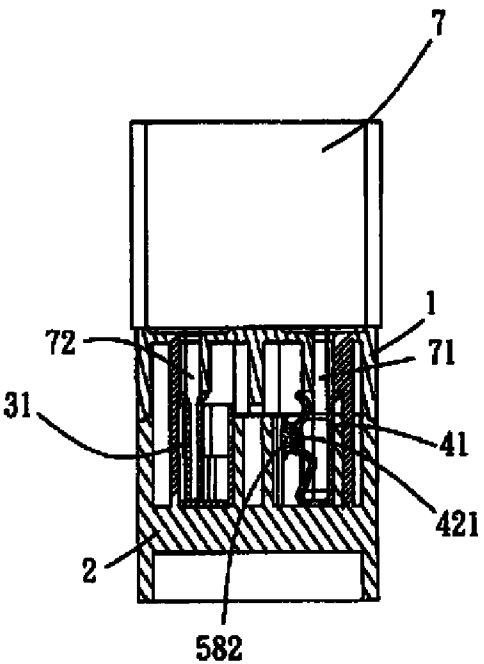
FIG. 18C is a sectional side view illustrating after insertion of the plug according to the third embodiment of the present invention.
Figure 19B:
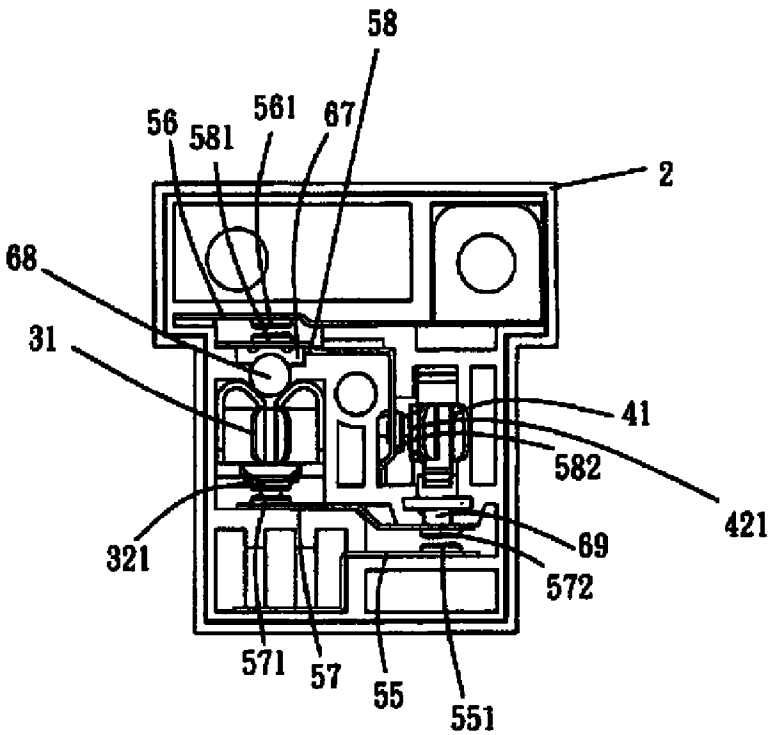
FIG. 19B is a top view illustrating before the insertion of the plug according to the third embodiment of the present invention.
Figure 19A:
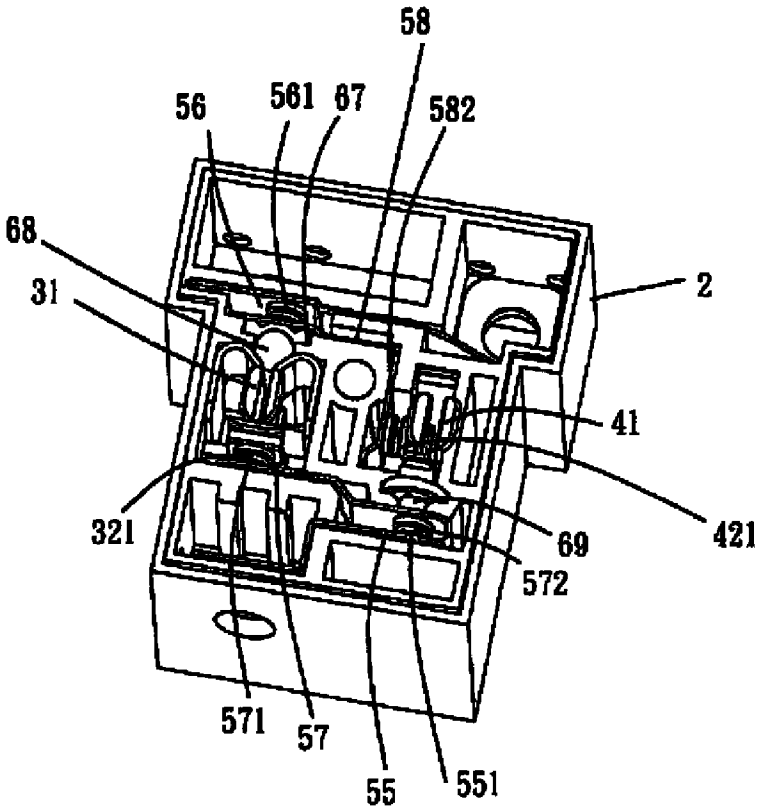
FIG. 19A is an elevational view according to the third embodiment of the present invention.
Figure 20:
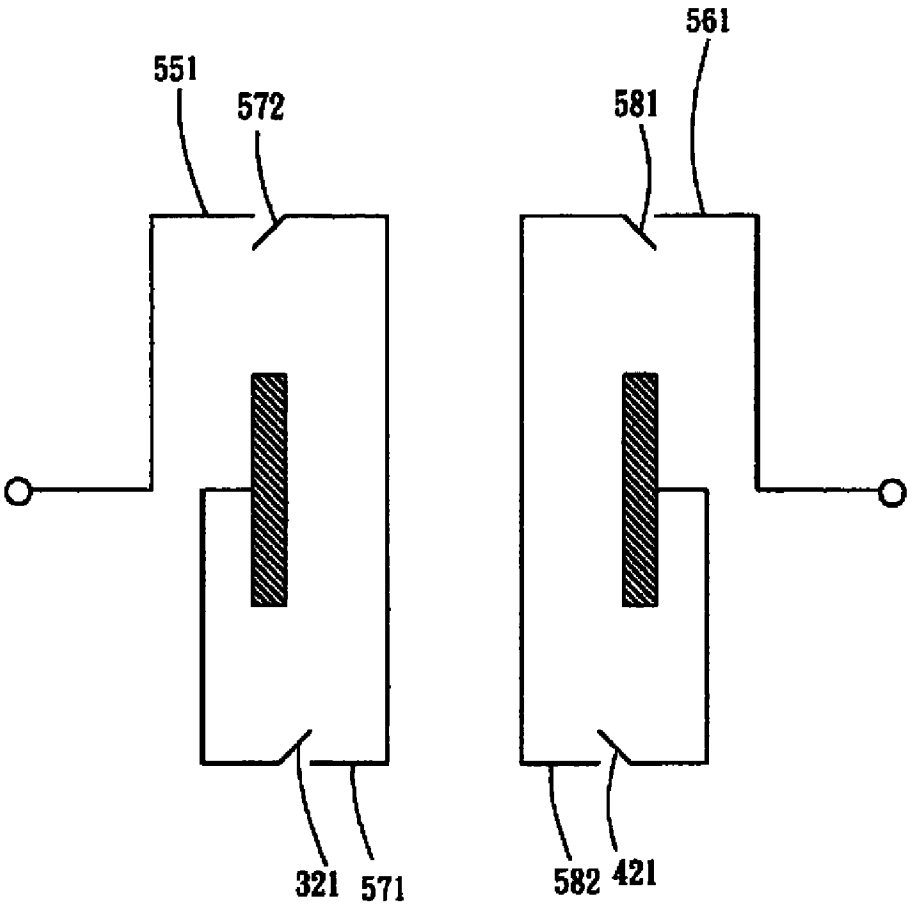
FIG. 20 is an aspect illustrating the loop according to the third embodiment of the present invention.
Figure 21:
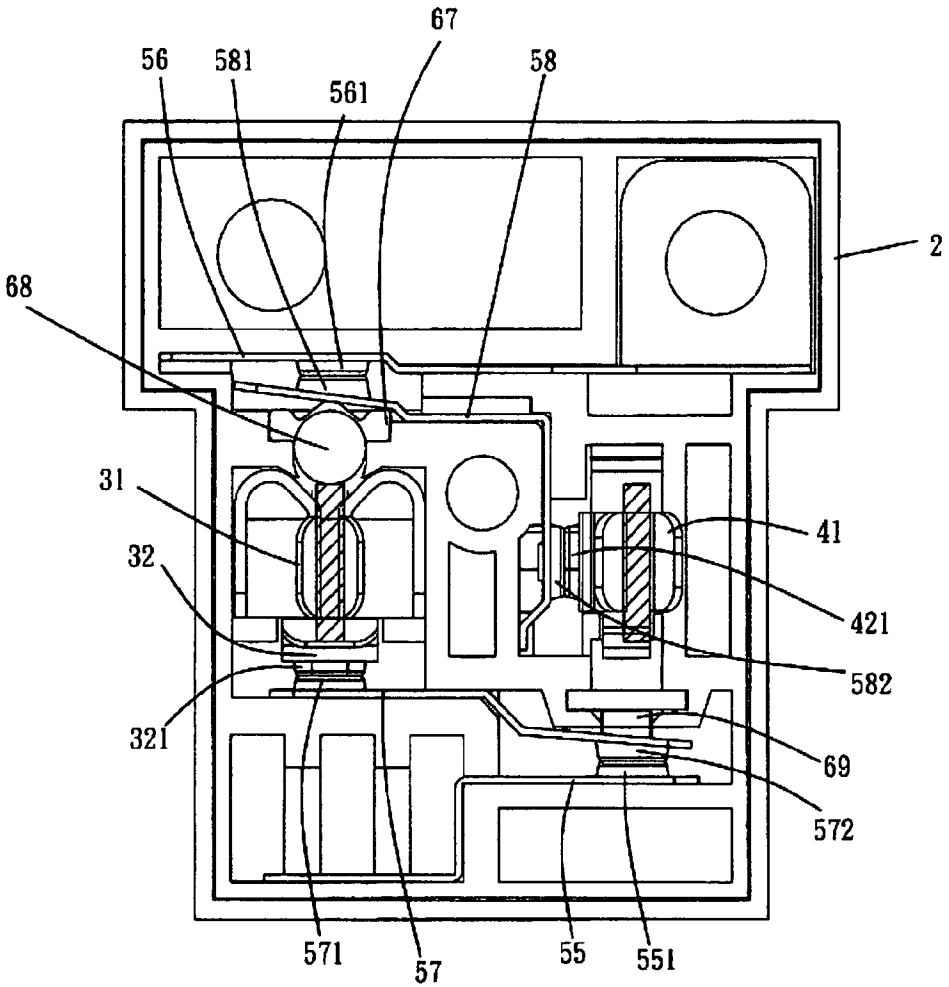
FIG. 21 is a top view illustrating while inserting the plug according to the third embodiment of the present invention.

When the plug 7 is plugged in downwardly, the pins 71 and 72 of the plug 7 come in contact with the elastic plate 31, 41 and the contact plates 32 and 42 of the insertion objects 3 and 4 and bend the contact plates 32 and 42 outwardly, the contact portions 321 and 421 of the contact plates 32 and 42 contact the contact portions 571 and 582 of the movable plates 57 and 58 (referring to FIG. 18C and FIG. 21). When the plug 7 is plugged in completely, the pin 71 moves the ball 68 towards the block 67 to further make the block 67 to contact the contact portion 581 of the movable plate 58 and the contact portion 561 of the fixture plate 56. Meanwhile the pin 72 pushes the tray protrusion 69 towards the contact portion 572 of the movable plate 57, thus make the contact portion 572 of the movable 57 to come in contact with the contact portion 551 of the fixture plate 55, and the loop of the socket is turned on. In another word, the live wire input power can be transmitted to the elastic plate 41 to further enable the plug 7 receive the electricity.

Figure 22:
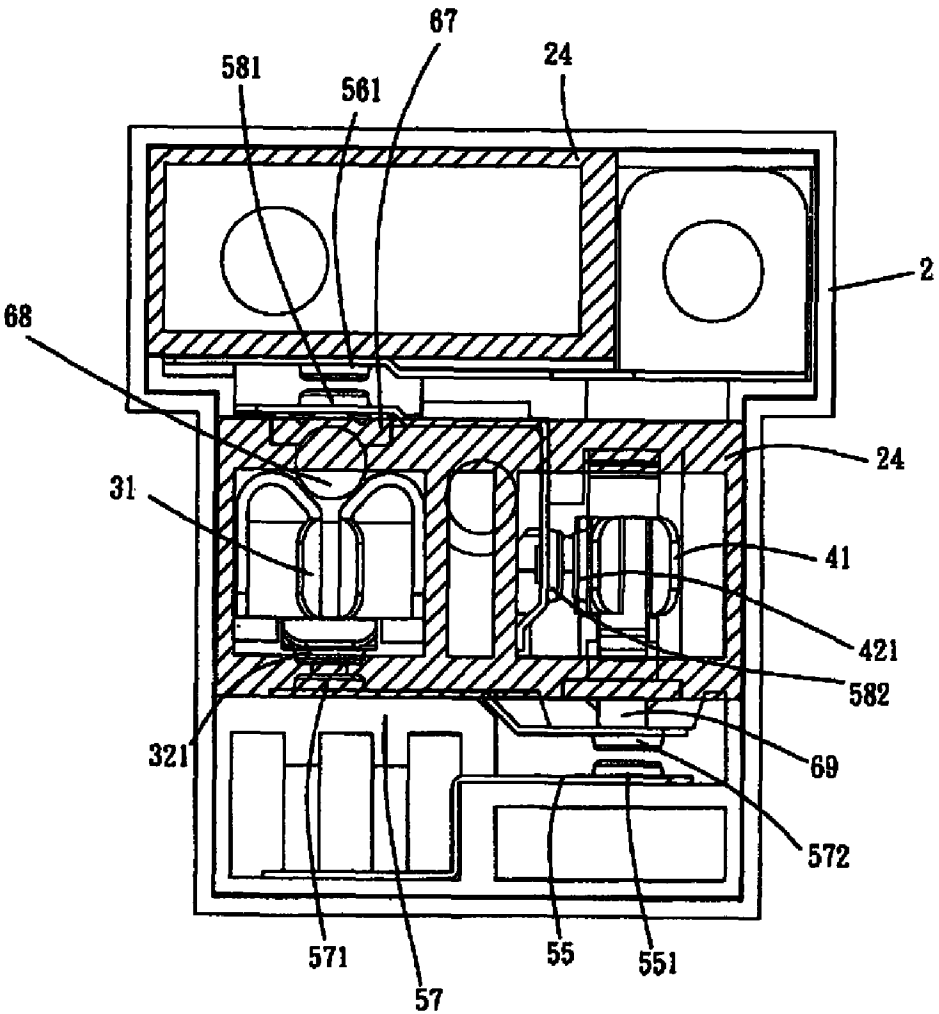
FIG. 22 is an aspect illustrating covering a waterproof layer onto the base according to the third embodiment of the present invention.
Figure 23:
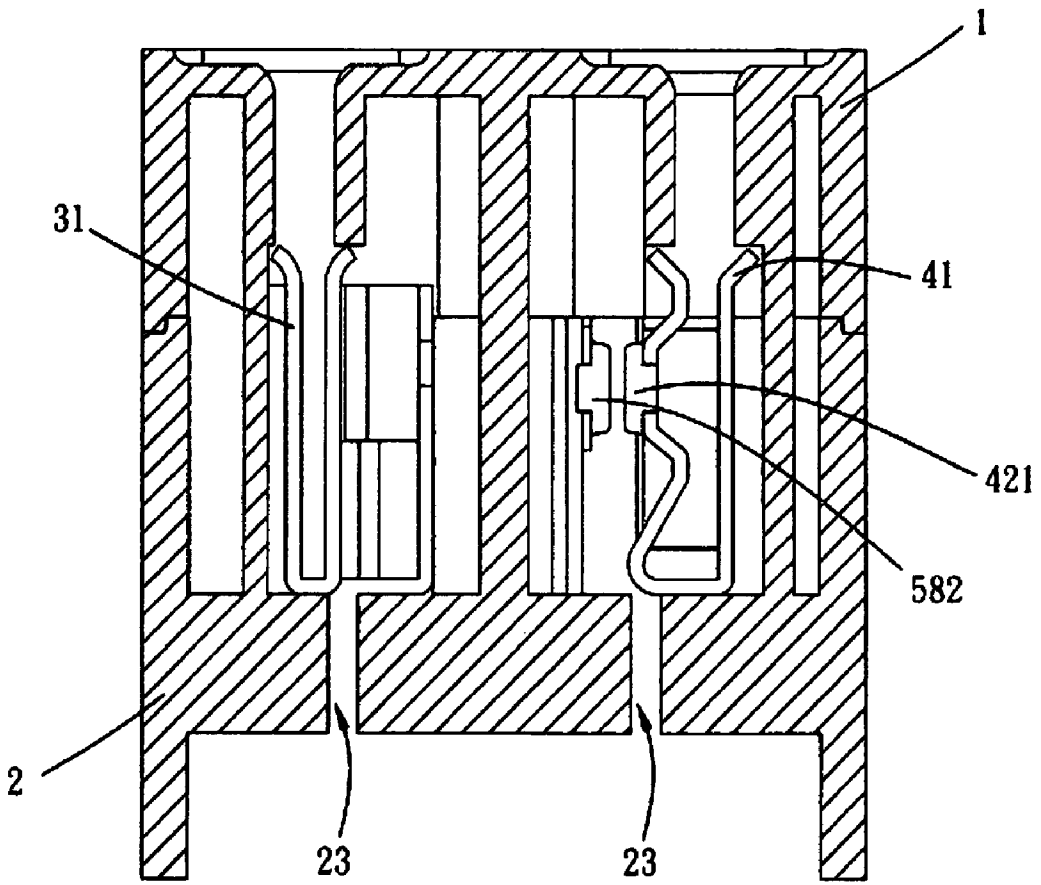
FIG. 23 is a sectional side view according to the third embodiment of the present invention.

Although the upper lid 1 can prevent liquid flowing in, however the existence of the insertion holes 11 is for adapting the pins 71, 72 of the plug 7, and it's hard to prevent liquid to get into the base 2 thereby. Referring to FIGS. 22 and 23, the embodiment has a waterproof layer 24 between the upper lid 1 and the base 2. The waterproof layer 24 covers the elastic plates 31 and 41 of the insertion plates 3 and 4, and at least one groove 23 is formed at the bottom of the base near the elastic plates 31 and 41. Thus, when the liquid flows in through the insertion holes 11 of the upper lid 1, the liquid is blocked by the waterproof layer 24 to restrict the flow going towards the elastic plates 31 and 41, and lead to flow out of the base 2 from the groove 23 near the elastic plates 31 and 41. Therefore, the fixture plates, the movable plates and movable elements and other elements positioned on top of the base 2 will be protected from the liquid to avoid electric shock, and waterproof effect can be substantially achieved.

According to the above depiction, the present invention can achieve the expected purpose; to use the combination of the inserting object, the touch tone loop and the movable element for having contact or positioning apart of the contact portions between the touch tone loop and the insertion object can substantially turn the loop formed by the insertion object, the fixture plates and the movable plate on or off, and the waterproof layer and the groove of the base can substantially prevent electric shock from occurring due to plugging error and to provide the waterproof effect.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What is claimed is:

1. An electric socket, comprising:

an upper lid, having at least two insertion holes;

a base, having two axles;

two insertion objects, respectively having two elastic plates and two contact plates, said contact plates respectively having a contact portion;

a touch switch loop, having two movable plates and two fixture plates; said movable plates respectively having a first contact portion, and said fixture plates respectively having a second contact portion positioned corresponding to contact portions of said contact plates, and two third contact portions respectively positioned corresponding to first contact portions of said movable plates; and a movable element, comprising two bars, two blocks and two elastic elements; said bars respectively having an end connected to said movable plates and another end thereof respectively connected to blocks; and said elastic elements respectively positioned below said blocks;

wherein said insertion objects, said touch switch loop and said movable element are positioned within said upper lid and said base; said movable element is positioned below said insertion objects; thus with a contact or a non-contact between said contact portions of said touch switch loop with said contact portions of said insertion objects accordingly turn on or off a loop formed by said insertion objects, said fixture plates and said movable plates.

2. An electric socket according to any of claim 1, wherein said bars and blocks of said movable element are made of an insulating material.

3. An electric socket according to any of claim 1, wherein said electrical socket further comprises two elastic plates and two fixture plates.

4. An electric socket according to any of claim 1, wherein said insertion objects further respectively comprises an elastic element connecting to said contact plates.

5. An electric socket according to any of claim 1, wherein said contact portions of said electrical socket are separate from each other and said touch switch loop can be conducted by plugging a standard size of the plug.

6. An electric socket according to any of claim 1, wherein said contact portions of said insertion objects, and said contact portions of said touch switch loop can be on various positions depending on the requirement.

7. An electric socket according to any of claim 1, wherein a waterproof layer is disposed between said upper lid and said base.

8. An electric socket according to any of claim 1, wherein said base has at least one groove formed at a bottom thereof.

9. An electric socket, comprising:

an upper lid, having at least two insertion holes;

a base;

two insertion objects, respectively having two elastic plates and two contact plates, said contact plates respectively having a contact portion;

a touch switch loop, having two movable plates and two fixture plates; said movable plates respectively having a first contact portion, and said fixture plates respectively having a second contact portion positioned corresponding to contact portions of said contact plates, and two third contact portions respectively positioned corresponding to first contact portion of said movable plates; and a movable element, comprising two blocks and two elastic elements; said elastic elements respectively positioned below said blocks;

wherein said insertion objects, said touch switch loop and said movable element are positioned within said upper lid and said base; said movable element is positioned below said insertion objects; thus with a contact or a non-contact between said contact portions of said touch switch loop with said contact portions of said insertion objects accordingly turn on or off a loop formed by said insertion objects, said fixture plates and said movable plates.

10. An electric socket, comprising:

an upper lid, having at least two insertion holes;

a base;

two insertion objects, respectively having two elastic plates and two contact plates, said contact plates respectively having a contact portion;

a touch switch loop, having two movable plates and two fixture plates; said fixture plates respectively having a first contact portion, and said movable plate respectively having a second contact portion positioned corresponding to contact portions of said contact plates, and a two third contact portions respectively positioned corresponding to first contact portions of said fixture plates; and a movable element, comprising a block, a ball and an tray protrusion; said ball positioned against an end of said block, and said tray protrusion positioned between said second contact portion of said first movable plate and said elastic plate;

wherein said insertion objects, said touch switch loop and said movable element are positioned within said upper lid and said base; said movable element is positioned below said insertion objects; thus with a contact or a non-contact between said contact portion of said touch switch loop with said contact portion of said insertion objects accordingly turn on or off a loop formed by said insertion objects, said fixture plates and said movable plates.

* * * * *